US005755065A

United States Patent [19]

Sorkin

[11] Patent Number: 5,755,065

[45] Date of Patent: May 26, 1998

[54] METHOD AND APPARATUS FOR FORMING AN ANCHORAGE OF A POST-TENSION SYSTEM

[76] Inventor: Felix L. Sorkin, 4115B Greenbriar Dr., P.O. Box 1503, Stafford, Tex. 77477

[21] Appl. No.: 638,886

[22] Filed: Apr. 25, 1996

[51] Int. Cl.[6] ..... E04C 5/12

[52] U.S. Cl. ..... 52/223.13; 52/745.21

[58] Field of Search ..... 52/223.13, 745.21

[56] References Cited

U.S. PATENT DOCUMENTS

| | | | |
|---|---|---|---|
| 4,640,068 | 2/1987 | Jungwirth et al. | 52/223.13 |
| 4,718,209 | 1/1988 | Hansen et al. | 52/223.13 |
| 5,055,021 | 10/1991 | Bonato | 52/223.13 X |
| 5,072,558 | 12/1991 | Sorkin . | |
| 5,440,842 | 8/1995 | Sorkin | 52/223.13 |

OTHER PUBLICATIONS

VSL Corporation, VSL Post–Tensioning Systems, Mar. 1994, pp. 17–18, 24–27.

*Primary Examiner*—Christopher Kent

[57] ABSTRACT

A post-tension system including an anchor member having a tendon-receiving interior passageway, a tendon extending through the passageway, a plurality of wedges interposed between the anchor member and the tendon in the interior passageway, and a spring received by one end of the anchor member so as to be in compressive relationship with the plurality of wedges so as to urge the plurality of wedges in a direction toward an opposite end of the anchor member. A cap member is affixed to one end of the anchor member and extends over an end of the tendon. The spring is interposed between the cap and the plurality of wedges. The spring is affixed to an interior shoulder on the cap member. A seal is interposed between an exterior surface of a sheathed portion of the tendon and an interior surface of a tubular extension formed in an encapsulation around the anchor.

14 Claims, 2 Drawing Sheets

METHOD AND APPARATUS FOR FORMING AN ANCHORAGE OF A POST-TENSION SYSTEM

TECHNICAL FIELD

The present invention relates to post-tension systems. More particularly, the present invention relates to methods and apparatus for forming a dead-end anchorage of a post-tension system. Additionally, the present invention relates to methods and apparatus for preventing water intrusion into the post-tension system.

BACKGROUND ART

For many years, the design of concrete structures imitated the typical steel design of column, girder and beam. With technological advances in structural concrete, however, its own form began to evolve. Concrete has the advantages of lower cost than steel, of not requiring fireproofing, and of its plasticity, a quality that lends itself to free flowing or boldly massive architectural concepts. On the other hand, structural concrete, though quite capable of carrying almost any compressive load, is weak in carrying significant tensile loads. It becomes necessary, therefore, to add steel bars, called reinforcements, to concrete, thus allowing the concrete to carry the compressive forces and the steel to carry the tensile forces.

Structures of reinforced concrete may be constructed with load-bearing walls, but this method does not use the full potentialities of the concrete. The skeleton frame, in which the floors and roofs rest directly on exterior and interior reinforced-concrete columns, has proven to be most economic and popular. Reinforced-concrete framing is seemingly a quite simple form of construction. First, wood or steel forms are constructed in the sizes, positions, and shapes called for by engineering and design requirements. The steel reinforcing is then placed and held in position by wires at its intersections. Devices known as chairs and spacers are used to keep the reinforcing bars apart and raised off the form work. The size and number of the steel bars depends completely upon the imposed loads and the need to transfer these loads evenly throughout the building and down to the foundation. After the reinforcing is set in place, the concrete, a mixture of water, cement, sand, and stone or aggregate, of proportions calculated to produce the required strength, is placed, care being taken to prevent voids or honeycombs.

One of the simplest designs in concrete frames is the beam-and-slab. This system follows ordinary steel design that uses concrete beams that are cast integrally with the floor slabs. The beam-and-slab system is often used in apartment buildings and other structures where the beams are not visually objectionable and can be hidden. The reinforcement is simple and the forms for casting can be utilized over and over for the same shape. The system, therefore, produces an economically viable structure. With the development of flat-slab construction, exposed beams can be eliminated. In this system, reinforcing bars are projected at right angles and in two directions from every column supporting flat slabs spanning twelve or fifteen feet in both directions.

Reinforced concrete reaches its highest potentialities when it is used in pre-stressed or post-tensioned members. Spans as great as five hundred feet can be attained in members as deep as three feet for roof loads. The basic principle is simple. In pre-stressing, reinforcing rods of high tensile strength wires are stretched to a certain determined limit and then high-strength concrete is placed around them.

When the concrete has set, it holds the steel in a tight grip, preventing slippage or sagging. Post-tensioning follows the same principle, but the reinforcing tendon, usually a steel cable, is held loosely in place while the concrete is placed around it. The reinforcing tendon is then stretched by hydraulic jacks and securely anchored into place. Pre-stressing is done with individual members in the shop and post-tensioning as part of the structure on the site.

In a typical tendon tensioning anchor assembly used in such post-tensioning operations, there are provided anchors for anchoring the ends of the cables suspended therebetween. In the course of tensioning the cable in a concrete structure, a hydraulic jack or the like is releasably attached to one of the exposed ends of each cable for applying a predetermined amount of tension to the tendon, which extends through the anchor. When the desired amount of tension is applied to the cable, wedges, threaded nuts, or the like, are used to capture the cable at the anchor plate and, as the jack is removed from the tendon, to prevent its relaxation and hold it in its stressed condition.

In typical post-tension systems, the tendon is received between a pair of anchors. One of the anchors is known as the "live end" anchor and the opposite end is known as the "dead-end" anchor. The "live end" anchor receives the end of the tendon which is to be tensioned. The "dead-end" anchor holds the tendon in place during the tensioning operation. Under typical operations, a plurality of wedges are inserted into an interior passageway of the anchor and around the exterior surface of the tendon. The tendon is then tensioned so as to draw the wedges inwardly into the interior passageway so as establish compressive and locking contact with an exterior surface of the tendon. This dead-end anchor can then be shipped, along with the tendon, for use at the job site.

Corrosion and water intrusion have been problems which have greatly afflicted such dead-end anchorages. Since the anchor is attached to the tendon at the manufacturing facility, water intrusion can often occur during storage, shipment, or installation. Often, procedures are rather sloppy in preventing water intrusion during these activities. If water has already intruded into the interior of the dead-end anchor, then any liquid-tight seals will only serve to keep the water in corrosive contact with the tendon and the anchor.

One solution to the problem of water intrusion has been to attach a long tubular member to the end of the anchor such that it extends as long a length of the sheathed portion of the tendon. A seal is placed on the end of the tubular member opposite the anchor so as to establish a water-tight seal with the sheathed portion of the tendon. Unfortunately, water can often intrude into the interior of the tubular member prior to installation. As a result, the seal and the tubular member will only serve to keep the water in corrosive contact with the tendon. As such, a need has developed so as to form a seal which prevents water intrusion into the dead-end anchorage of a post-tension system.

It is an object of the present invention to provide a post-tension system in which the tendon is fully encapsulated.

It is another object of the present invention to provide a post-tension system which eliminates the need to stress the tendon during the formation of the dead-end anchor.

It is a further object of the present invention to provide a post-tension system which eliminates the need to place an extra tubular member around an unsheathed portion of the tendon at the dead-end anchor.

It is a further object of the present invention to provide a post-tension system which is easy to use, relatively inexpensive and easy to manufacture.

These and other objects and advantages of the present invention will become apparent from a reading of the attached specification and appended claims.

SUMMARY OF THE INVENTION

The present invention is a post-tension system that comprises an anchor member having a tendon-receiving interior passageway, a tendon extending through the interior passageway, a plurality of wedges interposed between the anchor member and the tendon in the interior passageway, and a spring means received by one end of the anchor member so as to be in compressive relationship with the plurality of wedges. The spring means serves to urge the plurality of wedges in a direction toward an opposite end of the anchor member.

In the present invention, a cap member is affixed to the end of the anchor member and extends over an end of the tendon. The spring means is interposed between the cap and the plurality of wedges. In particular, the cap has an interior shoulder formed therein. The spring means is affixed to the interior shoulder and extends outwardly therefrom.

The spring means is an annular spring having a surface in abutment with one end of the plurality of wedges. The tendon has an end which extends through a central opening in the annular spring. In particular, the spring means is a finger spring washer which exerts a compressive force of not less than ten pounds per square inch onto the end of the plurality of wedges.

In the present invention, the anchor member is a polymeric encapsulated anchor having a tubular extension formed on an opposite end of the anchor member. The tendon extends through the tubular extension. The tendon has a sheathed portion and an unsheathed portion. The spring means serves to urge the plurality of wedges into compressive contact with an exterior surface of the unsheathed portion of the tendon. A seal is interposed between an exterior surface of the sheathed portion and an interior surface of the tubular extension. The seal serves to prevent liquid intrusion into the unsheathed portion.

The present invention is also a method of forming a dead-end anchorage in a post-tension system that comprises the steps of: (1) extending a tendon through an interior passageway of the anchor such that the end of the tendon extends outwardly of the interior passageway; (2) inserting at least one wedge into the interior passageway such that the wedge is interposed between the anchor and the tendon; and (3) placing a spring member against an end of the wedge such that the spring member exerts a compressive force against the wedge so as to urge the wedge into compressive contact with the tendon.

DETAILED DESCRIPTION OF THE INVENTION

Figure 1:
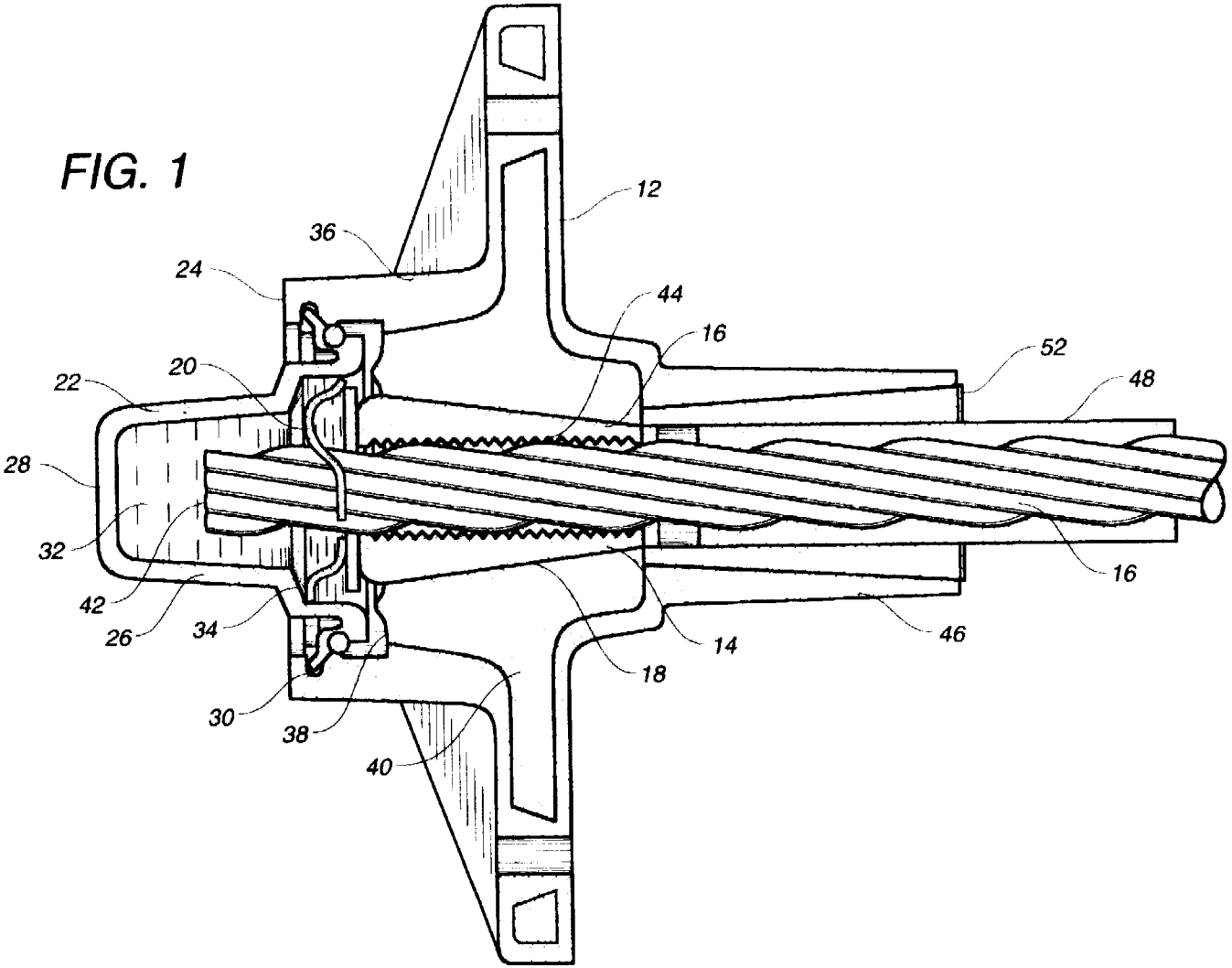
FIG. 1 is a cross-sectional view of the dead-end anchor of the post-tension system of the present invention.

Referring to FIG. 1, there is shown at 10 the post-tension system in accordance with the teachings of the present invention. The post-tension system 10 includes an anchor member 12 having a tendon-receiving interior passageway 14, a tendon 16 extending through the interior passageway 14, wedges 16 and 18 interposed between the anchor member 12 and the tendon 16 in the interior passageway 14, and a spring 20 received by the anchor member 12 so as to be in compressive relationship with the wedges 16 and 18. As can be seen in FIG. 1, the spring 20 serves to urge the wedges 16 and 18 in a direction toward an opposite end of the anchor member 12.

In FIG. 1, it can be seen that a cap member 22 is affixed to an end 24 of the anchor member 12. The cap member 22 includes a tubular body 26 with a closed end 28. A snap-fit connector 30 is formed on an end of the tubular body 26 opposite the closed end 28. A corrosion-inhibiting material 32 can be received on the interior of the tubular body 26 of the cap member 22. A shoulder 34 is formed on the tubular body 26 adjacent the attachment end 30.

In FIG. 1, it can be seen that the spring 20 is affixed against the shoulder 34 on the interior of the cap 22. When the cap 22 has its attachment end 30 connected to the end 24 of the anchor 12, the shoulder 34 will cause the spring 22 to exert compressive contact against the ends of the wedges 16 and 18. It should be noted that the attachment end 30 can be made of various forms. As shown in FIG. 1, the end 30 is in snap-fit engagement with a polymeric encapsulation 36 of the anchor member 12. In other embodiments, the attachment end 30 can be in threaded engagement with the end 24 of the anchor 12. Various other configurations are possible for the attachment end 30. In general, it is only important that the attachment end 30 be in secure engagement onto and over the end 38 of the steel anchor 40. The encapsulation 36 serves to maintain the anchor 40 in a sealed condition.

In FIG. 1, it can be seen that the spring 20 extends over and around the end 42 of the tendon 16. The spring 20 serves to urge the wedges 16 and 18 into the tapered internal cavity 44 of the anchor member 12. As the wedges 16 and 18 are forced toward the opposite end of the internal cavity 44 of the anchor member 12, the wedges 16 and 18 will exert a compressive contact with the exterior surface of the unsheathed portion of the tendon 16. As such, the spring 20 serves to cause the wedges 16 and 18 to be in a proper position for securing the end 42 of the tendon 16 during the tensioning of the tendon 16 at the opposite end.

In FIG. 1, the anchor member 12 includes a polymeric encapsulation 36 extending over the exterior surface of the steel anchor 40. A tubular extension 46 is formed in the polymeric encapsulation 36 so as to extend outwardly of an opposite end of the anchor member 12. The tubular extension 46 will extend around an exterior surface of a sheathed portion 48 of the tendon 16. As can be seen, the tendon 16 has a sheathed portion 48 and an unsheathed portion 50. The sheathing 48 around the exterior of the tendon 16 serves to prevent water intrusion thereinto. A seal 52 is interposed between an exterior surface of the sheathed portion 48 and an interior surface of the tubular extension 46. The seal 52 serves to establish a liquid-tight barrier so as to prevent water intrusion into the area of the unsheathed portion 50, the wedges 16, and the steel anchor 40. The cap 22, along with the corrosion-resistant material 32, serves to prevent water intrusion into the opposite end of the anchor member 12.

Figure 2:
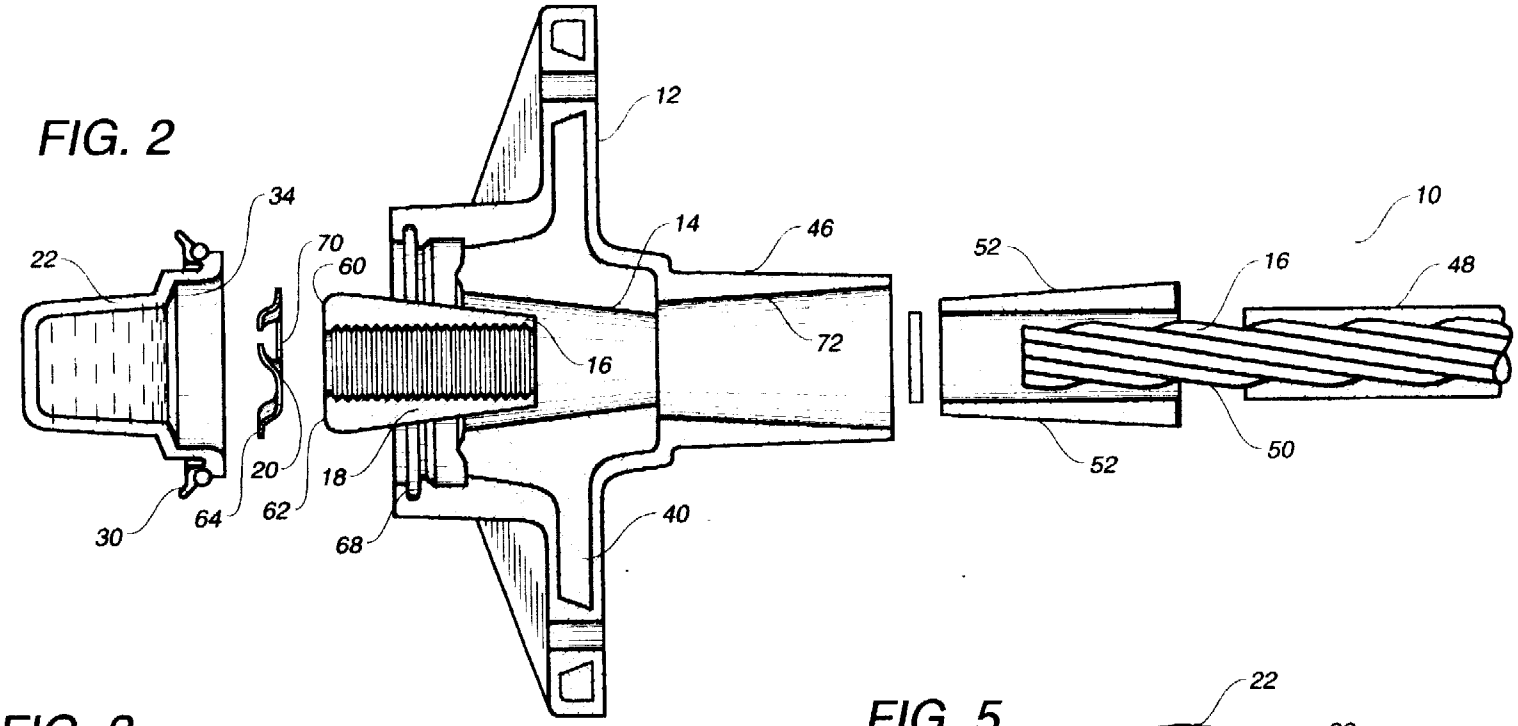
FIG. 2 is an exploded cross-sectional view of the dead-end anchor of the post-tension system of the present invention.

FIG. 2 shows an exploded view of the post-tension system 10. In particular, in FIG. 2, it can be seen that the anchor member 12 has an interior passageway 14 for the receipt of wedges 16 and 18. It is important to note that a plurality of wedges are used so as to properly secure the tendon 16 within the interior passageway 14. However, it is also conceivable that a single wedge could be used in place of a plurality of wedges. As such, the present invention should not be limited by the number of wedges which are used on the interior passageway 14.

Each of the wedges 16 and 18 has a somewhat tapered configuration which conforms to the angle of the tapered interior passageway 14 of the anchor member 12. As each of the wedges 16 and 18 are pushed inwardly through the interior passageway 14 they will compress so as to form a tight fit with the exterior surface of the unsheathed portion 50 of the tendon 16. In order to establish such compressive contact, it is important to create a compressive force onto the ends 60 and 62 of wedges 16 and 18, respectively. The spring member 20 is configured so as to cause such compressive force. The cap 22 has an interior shoulder 34 which serves to abut a surface 64 of the spring member 20. When the attachment end 30 of the cap 22 is received within the receptacle 68 of the anchor member 12, the shoulder 34 will exert a force against the surface 64 so as to transfer the force such that a surface 70 of the spring member 20 is in compressive contact with the ends 60 and 62 of the wedges 16 and 18, respectively.

Before the cap 22 is installed within the receptacle 68 of the anchor member 12, the tendon 16 is inserted through the interior passageway 14 such that the unsheathed portion 50 resides in the interior passageway 14. After the unsheathed portion 50 of the tendon 16 is inserted into the interior passageway 14, the wedges 16 and 18 are placed so as to be interposed between the exterior surface of the unsheathed portion 50 and the inner wall of the interior passageway 14. The spring member 20 and the cap 22 can then be placed over the ends 60 and 62 of the wedges 16 and 18, respectively, so as to fixedly receive the unsheathed portion 50 of the tendon 16 within the interior passageway 14 of the anchor 12. The seal 52 can then be inserted so as to be interposed between the sheathed portion 48 and the inner surface 72 of the tubular extension 46 of the anchor member 12. The seal 52 can be separate seal members or it can be a single elongated O-ring seal.

Figure 3:
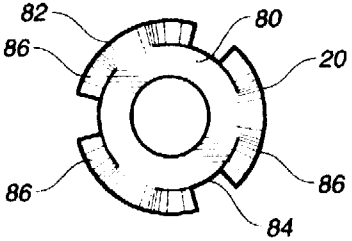
FIG. 3 is a frontal view of the spring used in the system of the present invention.

FIG. 3 shows the spring member 20 as used in the preferred embodiment of the present invention. As used in the preferred embodiment of the present invention, the spring member 20 is known as a finger spring washer. In normal application, these finger spring washers are used for preloading ball bearings. The finger spring washer is one possible embodiment of the spring member 20 of the present invention. However, within the scope of the present invention, various other types of springs can be used. Experiments have indicated that it is preferable to use a spring member 20 that can exert a compressive force against the ends 60 and 62 of the wedges 16 and 18, respectively, in excess of ten pounds per square inch.

As can be seen in FIG. 3, the spring member 20 includes a first annular surface 80 and a second annular surface 82. The first annular surface 80 is configured so as to be in surface-to-surface contact with the ends 60 and 62 of the wedges 16 and 18, respectively. The first annular surface 80 includes an interior opening 84. The interior opening 84 should have a greater diameter than the unsheathed portion 50 of the tendon 16. In this manner, the unsheathed portion 50 of the tendon 16 can extend outwardly through the interior opening 84. The second annular surface 82 includes a plurality of ring segments 86 which are suitable for contacting the interior shoulder 34 of the cap member 22. The first annular surface 80 extends outwardly from the second annular surface 82 in resilient relationship therewith. The second annular surface 82 will also have an interior opening which accommodates the diameter of the unsheathed portion 50 of the tendon 16.

Figure 4:
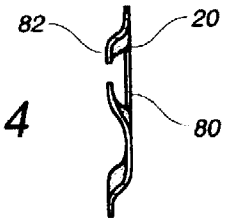
FIG. 4 is a side elevational view of the spring of the present invention.

FIG. 4 is a side view showing the configuration of the spring member 20 of the present invention. As can be seen, the first annular surface 80 is formed so as to be in compressive contact with the ends 60 and 62 of the wedges 16 and 18. The second annular surface 82 extends outwardly from the first annular surface 80. The second annular surface 82 is made up of a plurality of ring segments 86 which are in contact with the interior shoulder 34 of the cap member 22.

Figure 5:
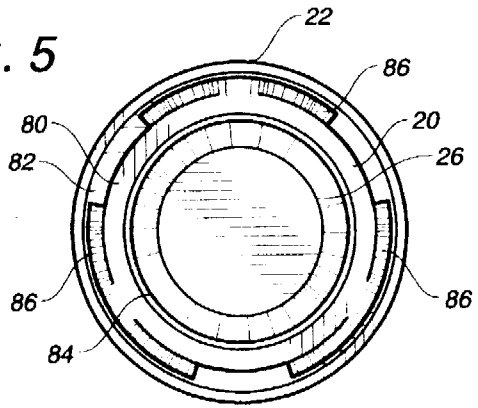
FIG. 5 is an end view showing the spring as installed within the cap of the dead-end anchor of the present invention.

FIG. 5 shows the spring member 20 as installed on the interior of the cap member 22. Initially, it can be seen that the ring segments 86 of the second annular surface 82 reside against a shoulder 34 on the interior of the cap 22. The first annular surface 80 is formed inwardly of the second annular surface 82. The interior opening 84 of the first annular surface 80 is sufficiently large so as to accommodate the outer diameter of the unsheathed portion 50 of the tendon 16. The tubular body 26 of cap member 22 also serves to receive the unsheathed portion 50 of the tendon 16.

The present invention achieves major advantages over prior dead-end anchorages. Most importantly, the assembly of the dead-end anchorage of the present invention can be accomplished without the tensioning of the tendon 16. In normal practice, the sheathing which covers the portion 50 of the tendon 16 is removed for a short distance from the end 42 of the tendon 16. The length of the unsheathed portion 50 should be slightly greater than the length of the interior passageway 14 of the anchor member 12. After the unsheathed portion 50 is placed within the interior passageway 14, the dead-end anchorage is completed by inserting the wedges and attaching the spring-loaded cap member 22. After the cap 22 is installed onto the end of the anchor member 12, the spring 20 exerts compressive contact against the ends of the wedges 16 so as to provide a "locking" force against the exterior surface of the tendon 16. As a result, there is no need to tension the tendon 16, prior to the tensioning of the live end anchor, so as to cause the wedges 16 and 18 to be in compressive contact with the tendon.

It is important to remember that under conventional practice, when the tendon 16 is stressed so as to form the dead-end anchor, the unsheathed portion 50 will extend outwardly of the anchor member 12 for a large distance. As a result, some of the unsheathed portion 50 of the tendon 16 would reside in an exposed location outside of the tubular extension 46 of the anchor member 12. By not stressing the tendon 16, the sheathed portion 48 of the tendon 16 will reside, in sealed relationship, within the interior of the tubular extension 46. As such, the present invention avoids the need to apply long tubular members or other devices which can entrap corrosive liquids therein.

Since the present invention can be assembled by simply affixing the preassembled cap 22 onto the end of the anchor member 12, there is a significant reduction in the amount of labor required for the assembly of the dead-end anchorage of the present invention. Furthermore, the simple arrangement of the post-tension system 10 of the present invention allows assembly of the dead-end anchorage at the job site. There is no need for special equipment for the purposes of tensioning the dead-end anchor so as to retain the wedges in their position within the interior passageway of the anchor.

The foregoing disclosure and description of the invention is illustrative and explanatory thereof. Various changes in the details of the illustrated configuration may be made within the scope of the appended claims without departing from the true spirit of the invention. The present invention should only be limited by the following claims and their legal equivalents.

I claim:

1. A post-tension system comprising:

a dead end anchor member having a tendon-receiving interior passageway;

a tendon extending through said interior passageway;

a wedge interposed between said anchor member and said tendon in said interior passageway;

a spring means received in one end of said anchor member so as to be in compressive relationship with said wedge, said spring means for urging said wedge in a direction toward an opposite end of said anchor member; and a cap member affixed to said one end of said anchor member and extending over an end of said tendon, said cap member having an interior shoulder formed therein, said spring means being affixed to said interior shoulder and extending outwardly therefrom.

2. The system of claim 1, said spring means being an annular member having a surface in abutment with one end of said wedge, said tendon having an end extending through a central opening in said annular member.

3. The system of claim 2, said spring means being a finger spring washer exerting a compressive force of not less than ten pounds per square inch onto said end of said wedge.

4. The system of claim 1, said anchor member being a polymeric encapsulated anchor having a tubular extension formed at said opposite end of said anchor member, said tendon extending through said tubular extension.

5. The system of claim 4, said tendon having a sheathed portion and an unsheathed portion, said spring means urging said wedge into compressive contact with an exterior surface of said unsheathed portion of said tendon.

6. The system of claim 5, further comprising:

a seal means interposed between an exterior surface of said sheathed portion and an interior surface of said tubular extension, said seal means for preventing liquid intrusion into said unsheathed portion.

7. A cap for a dead end anchor used in a post-tension system, the anchor having an interior passageway for receiving a plurality of wedges and a tendon of the post-tension system, the cap comprising:

a tubular body having a closed end;

an attachment means formed on said tubular body opposite said closed end, said attachment means for attaching the cap to an end of the anchor; and a spring means affixed within said tubular body adjacent said attachment means, said spring means for exerting a compressive force against an end of said plurality of wedges when the cap is affixed to the anchor, said spring means having a flat first annular surface for abutment with the plurality of wedges and a flat second annular surface in resilient and in generally parallel relationship with said first annular surface, said tubular body having an interior shoulder formed therein, said second annular surface juxtaposed against said interior shoulder.

8. The cap of claim 7, said first annular surface having an interior opening adapted to be of greater diameter than a diameter of the tendon.

9. The cap of claim 7, said second annular surface having an interior opening with a diameter adapted to be greater than the diameter of the tendon.

10. The cap of claim 7, said tubular body being filled with a corrosion-resistant material.

11. The cap of claim 7, said spring means being a finger spring washer.

12. A method of forming a dead-end anchorage in a post-tension system comprising the steps of:

extending a tendon through an interior passageway of an anchor such that an end of the tendon extends outwardly of the interior passageway, said anchor being an encapsulated anchor having a tubular extension extending outwardly of an end of said anchor, said tendon having a sheathed portion and an unsheathed portion, said tendon extending through said tubular extension;

inserting at least one wedge into said interior passageway such that said wedge is interposed between a wall of said interior passageway of said anchor and said unsheathed portion of said tendon;

placing a spring member against an end of the wedge such that said spring member exerts a compressive force against said wedge so as to urge said wedge into compressive contact with said tendon; and placing a seal member into said tubular extension such that said seal member is interposed between an exterior surface of said sheathed portion of said tendon and an interior surface of said tubular extension.

13. The method of claim 12, said step of placing a spring member comprising the steps of:

placing said spring member within a cap member; and affixing said cap member onto an end of said anchor such that said spring member is in compressive abutment with said wedge.

14. The method of claim 12, further comprising the step of:

tensioning an opposite end of said tendon such that said wedge is drawn into compressive locking contact with said tendon.

* * * * *